US005252046A

United States Patent [19]

Wen-Ding et al.

[11] Patent Number: 5,252,046

[45] Date of Patent: Oct. 12, 1993

[54] SELF-SEALING SCROLL COMPRESSOR

[75] Inventors: Tseng Wen-Ding, Tai-Chung City; Liu Da-Chuan, Taipei; Kuo Wen-Jen, Kao-Hsiung City; Chang Lung-Tsai, Taichung Hsien; Yang Chih-Cheng, Hsin Chu City; Tarng Guang-Der, Hsin Chu City; Lin Rui-Rung, Hsin Chu City; Lin Bao-Yuang, Hsin Chu Hsien; Ho Jan-Shiew, Hsin Chu Hsien, all of Taiwan

[73] Assignee: Industrial Technology Research Institute, Hsin Chu Hsien, Taiwan

[21] Appl. No.: 923,227

[22] Filed: Jul. 31, 1992

[51] Int. Cl.[5] ..... F04C 18/04; F04C 29/02

[52] U.S. Cl. ..... 418/55.5; 418/55.6; 418/57; 418/94; 418/100

[58] Field of Search ..... 418/55.5, 55.6, 57, 418/94, 100

[56] References Cited

FOREIGN PATENT DOCUMENTS

| | | | |
|---|---|---|---|
| 51-117304 | 10/1976 | Japan . | |
| 55-46081 | 3/1980 | Japan . | |
| 62-18758 | 4/1987 | Japan . | |
| 62-37238 | 8/1987 | Japan . | |
| 1159484 | 6/1989 | Japan | 418/55.5 |
| 2-9973 | 1/1990 | Japan | 418/55.5 |
| 3105089 | 5/1991 | Japan | 418/55.5 |
| 3149389 | 6/1991 | Japan | 418/55.5 |
| 77206560 | 5/1975 | Taiwan . | |

*Primary Examiner*—John J. Vrablik
*Attorney, Agent, or Firm*—Notaro & Michalos

[57] ABSTRACT

A scroll type compressor comprising a housing inside which a stationary scroll member and a frame are fixed to define a space therebetween large enough to receive therein an orbiting scroll member which inter-engages with the stationary scroll member to define therebetween a hermetical compression pocket into which the fluid to be compressed fills. An Oldham-coupling ring restricts the orbiting scroll member to orbit around the center of the stationary scroll wrap only. A back pressure chamber is in pressure connection with the compressed fluid through a lubricant for the compressor and also in fluid connection with an inlet of the fluid to be compressed through a capillary-like passage. A slot with a cross-sectional dimension larger than the capillary-like passage is connected between the capillary-like passage and the back pressure chamber and is so constructed that when the orbiting scroll member orbits, the slot is cyclically and repeated closed and re-opened by the orbiting scroll to establish a dynamic fluid resistance which, together with a static fluid resistance caused by the capillary-like passage, serve to maintain the back pressure at an approximately constant level for acting upon and thus forcing the orbiting scroll member toward the stationary scroll member.

7 Claims, 4 Drawing Sheets

SELF-SEALING SCROLL COMPRESSOR

FIELD OF THE INVENTION

The present invention relates generally to a scroll type compressor and in particular to a scroll compressor capable to self-seal the axial separation gap between the stationary scroll and the orbiting scroll with a back pressure of a suitable pressure level acting upon the scrolls thereof.

BACKGROUND OF THE INVENTION

Using scroll type plates to compress fluids has been known since ancient time. It is not until 1886 that a scroll type fluid treating apparatus was developed. An early patent (U.S. Pat. No. 801,182, "Rotary Engine") issued in 1905 to Leon Creux discloses this general type of device. Later in 1970, U.S. Pat. No. 3,884,599 provides the base for commercializing rotary fluid machines of this kind. Study and research have since significantly devoted to the development of the kind of machine.

The compression mechanism of the scroll type compressing apparatus comprises at least a housing or a frame inside which a stationary scroll is fixed, a crankshaft driven by a rotary motion driving means, such as an electrical motor, to drive an orbiting scroll which orbits around the center of the stationary scroll wrap, and an Oldham-coupling ring interposed between the frame and the orbiting scroll member to serve as an anti-rotation coupling means. Both scrolls are constituted by an end plate on which an involute wrap plate is normally fixed. The involute wraps of both scrolls have the same pitch so that when the wrap plates of the scrolls face-to-face inter-engage with each other, a sealed chamber is formed by the end plates and the wrap plates of the scrolls.

As described in U.S. Pat. No. 3,884,559 issued to young et al., the scroll type apparatus operates by moving the sealed chamber inside which fluid to be compressed is hermetically contained from one region to another region which may be at a different pressure If the fluid is moved from a lower to higher pressure region, the apparatus is serving as a compressor. If the movement is from the higher pressure region to the lower pressure region, then it is an expander. The movement of the sealed pocket of fluid is achieved by the orbiting motion of one scroll member around the center of the other scroll member. When the movement is in such a direction as to have the volume sealed chamber gradually reduced, the pressure of the fluid contained therein increases.

The conventional scroll type compressing apparatus suffers the problems of sealing and wearing which in general limit the efficiency of the apparatus. The sealing problem comes from that when the pressure of the sealed fluid increases, an increasingly great resultant force thereof acts upon the scrolls, intending to separate these scrolls apart and thus increasing the gap therebetween. Under the circumstances, the fluid contained in the sealed chamber will not be completely sealed.

The wearing problem comes from the sealing problem. To overcome the sealing problem, an external force which is at least greater than the largest resultant force of the fluid pressure is applied to the scrolls to hold them together. This results in a frictional contact between the scrolls and thus when the machine operates, the frictional contact between fixed parts and moving parts will result in wear therebetween.

Among the patents regarding scroll type compressor, U.S. Pat. No. 4,846,639 teaches the use of springs or external pressure source to generate the external force used to hold the scrolls together. As mentioned in the previous paragraph, such an external force results in a great frictional contact which requires a great start-up torque to start the machine.

Another way to overcome the sealing problem is disclosed in the Japanese Laid-open patent Application No. 55-46081 wherein high precision machined parts are assembled in a high precision way to form very small gaps between the scrolls. Such small gaps are filled with lubricant which forms thin films therein to block the gaps through which the compressed and thus pressurized fluid may escape. The disadvantage is that when the fluid is compressed and pressurized, its temperature will rise and during a long term operation, the temperature increase accumulated in the scrolls may be significant. In consequence, thermal expansion of the scrolls is inevitable and it may sometimes completely fill the gap between the scrolls. In that case, wearing occurs with the consequence of increase of driving torque and eventually burnout of the scrolls.

A further way to solve the sealing problem is to use tip sealing means. Creux (U.S. Pat. No. 801,182) has already taught using tip seal to overcome the sealing problem. Among the patents regarding scroll type compressor, U.S. Pat. Nos. 4,564,343, 4,740,143 and 4,864,639 and Japanese published patent Application Nos. 51-117304 and 57-180182 all teach the use of tip seal(s), although different in design, to seal the gap between the scrolls. Taiwanese Utility Model patent Application No. 77206560 also discloses a different design of the tip seal for scroll type compressor. The disadvantage of using tip seal is the increase of frictional drag force and the wear of the seal. Sometimes, it is also required high machining precision in installing tip seal.

Using the high pressure fluid generated by the compressor itself is another way to overcome the sealing problem. This design is disclosed in U.S. Pat. Nos. 3,600,114 and 4,365,941 and Japanese Laid-open patent Application Nos. 62-18758 and 62-37238. This is usually done by transferring high pressure fluid, which may be a fluid different from the fluid compressed by the movement of the scrolls, into a back pressure chamber to generate a force acting upon the orbiting scroll to move the orbiting scroll toward the stationary scroll and thus reducing the gap dimension therebetween. The disadvantage is that continuously conducting high pressure fluid to the back pressure chamber will certainly sacrifice volume efficiency of the compressor. Further, since the variation of pressure during the compression cycle will affect the stability of the back pressure and thus an over-pressurized model must be adopted to ensure a sufficient sealing force, an unnecessary friction is presented between the scrolls as a result. This results in a waste of energy.

It is therefore desirable to have a back pressurized self-sealing scroll type compressor wherein the pressure of the compressed fluid is transferred into the back pressure chamber to maintain the hermetical contact between the scrolls and thus eliminating leakage of the compressed fluid therethrough while a gap of a suitable dimension is maintained between the scrolls to eliminate frictional contact therebetween, a thick fluid, preferably the lubricant used to lubricate the compressor, being filled the gap between the scrolls to form a film blocking the gap to further seal the fluid that is being compressed from leaking through the gap

OBJECTS OF THE INVENTION

It is therefore the primary object of the present invention to provide a back pressurized self-sealing scroll type compressor wherein the pressure of the compressed fluid is transferred into a back pressure chamber through a thicker fluid, preferably a lubricant fluid for the compressor, to maintain a hermetical sealing between the scrolls and thus preventing the compressed fluid from leaking.

It is another object of the present invention to provide a back pressurized self-sealing scroll type compressor wherein the gap between the scrolls is filled with a thick fluid to form a fluid film for lubrication and reduction of the friction thereof.

It is a further object of the present invention to provide a back pressurized self-sealing scroll type compressor wherein a fluid connection is established between the back pressure chamber and an inlet of the fluid to be compressed to self-adjust the back pressure and thus keeping the back pressure approximately at a constant value, the connection being cyclically and repeatedly cut off and re-established through the movement of the orbiting scroll.

To achieve the above-mentioned object, there is provided a scroll type compressor comprising a housing inside which a stationary scroll member, which includes an end plate with an involute wrap secured thereon, and a frame are fixed to define a space therebetween large enough to receive therein an orbiting scroll member which also has an end plate and an involute wrap plate to inter-engage with the stationary scroll member to define therebetween a hermetical compression pocket into which the fluid to be compressed fills. An Oldham-coupling ring is interposed between the frame and the orbiting scroll member to guide the orbiting motion of the orbiting scroll member around the center of the stationary scroll wrap. A back pressure chamber is formed on the back side of the orbiting scroll member to be in pressure connection with the compressed fluid through a second, thicker fluid, preferably a lubricant for the compressor, and also in fluid connection with an inlet of the fluid to be compressed through a capillary-like passage formed on the stationary scroll member. A slot with a cross-sectional dimension larger than the capillary-like passage :s formed on the frame and is disposed between the capillary-like passage and the back pressure chamber. The slot is so constructed that when the orbiting scroll member orbits around the stationary scroll member, the slot is cyclically and repeated closed and re-opened to establish a dynamic fluid resistance which, together with a static fluid resistance caused by the capillary-like passage, serve to maintain the back pressure at an approximate constant level for acting upon and thus forcing the orbiting scroll member toward the stationary scroll member.

Other objects and advantages of the invention will be apparent from the following description of a preferred embodiment taken in connection with the accompanying drawings wherein:

DETAILED DESCRIPTION OF THE PREFERRED EMBODIMENT

Figure 6:
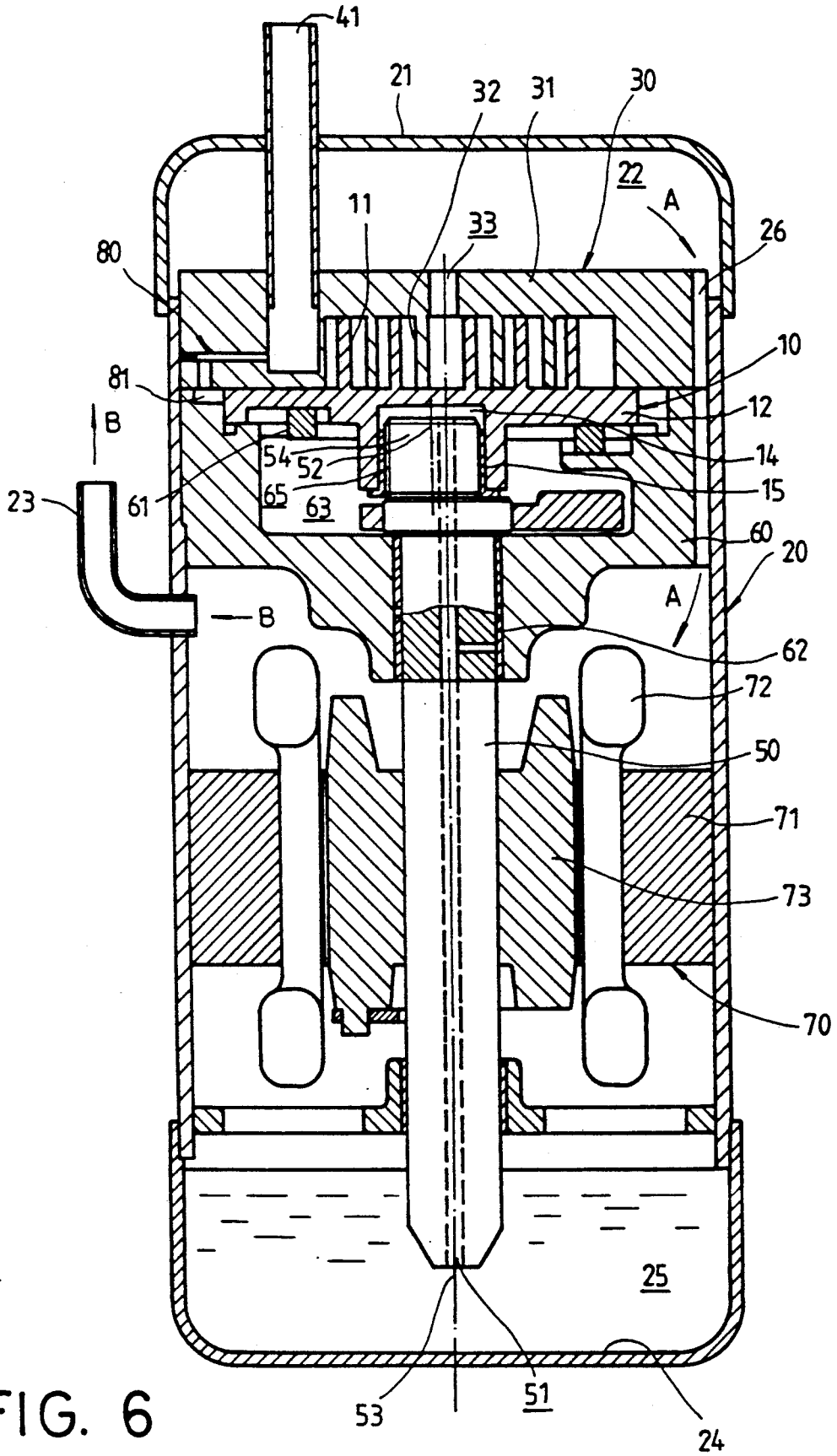
FIG. 6 is a cross-sectional view showing a scroll type compressor with the improvement in accordance with the present invention.

Referring to the drawings and in particular to FIG. 6 thereof, wherein a cross-sectional view of a scroll type compressor is shown, the scroll compressor comprises essentially a housing 20 inside which a frame 60 and a stationary scroll member 30 are fixed against movement relative thereto. A space is formed between the stationary scroll member 30 and the frame 60 to receive therein an orbiting scroll member 10 which is guided by a rotation preventive means or an Oldham-coupling ring 61 interposed between the frame 60 and the orbiting scroll member 10 to orbit around a center of the stationary scroll member 30.

Figure 1:
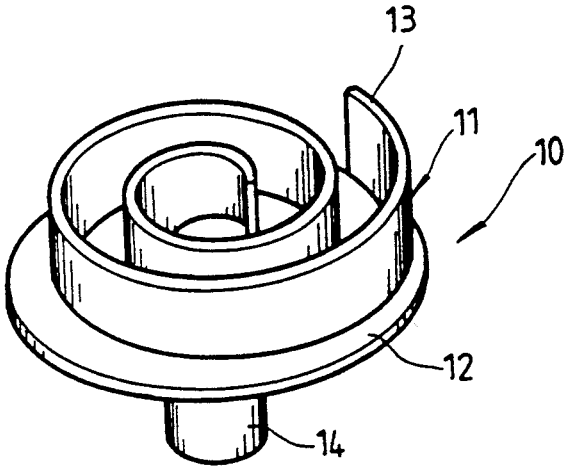
FIG. 1 is a perspective view showing an orbiting scroll member of a scroll type compressor.

Both of the stationary scroll member 30 and the orbiting scroll member 10 are constituted by an end plate 31 or 12 with a wrap plate 32 or 11, preferably in the form of an involute curve, perpendicularly mounted thereon, see FIG. 1 wherein a perspective view of a scroll member (the orbiting scroll member 10) is shown. Both the wrap plates 32 and 11 have the same pitch and inter-engages with each other so as to form a pair of matched scrolls. The engagement between the scroll members 10 and 30 is well known to the art and thus no further detail will be given herein. The inter-engagement of scrolls 32 and 11 may be best seen in FIGS. 2 to 5 wherein different phases of the compression cycle achieved with the movement of the orbiting scroll member 10 are shown in sequence. The orbiting scroll member 10 orbits around the center of the wrap plate 32 of the stationary scroll member 30.

Figure 2:
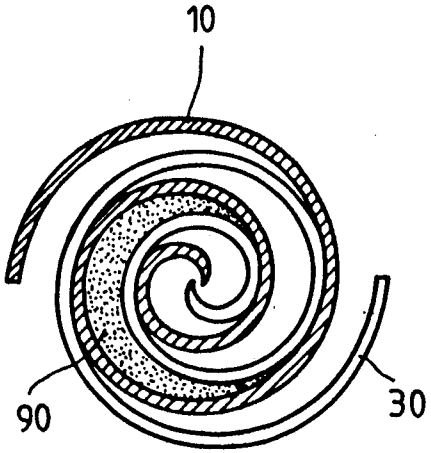
FIGS. 2–5 respectively show in sequence the operation process of a scroll type compressor with only the wrap plates of the scroll members shown.
Figure 3:
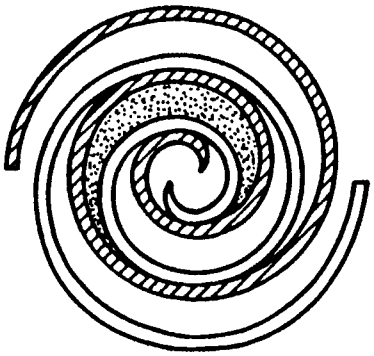
Figure 4:
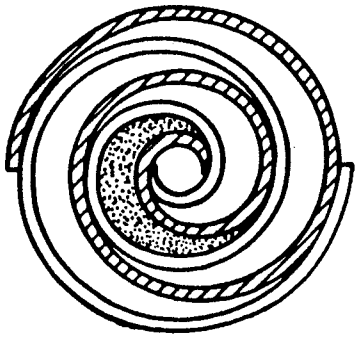
Figure 5:
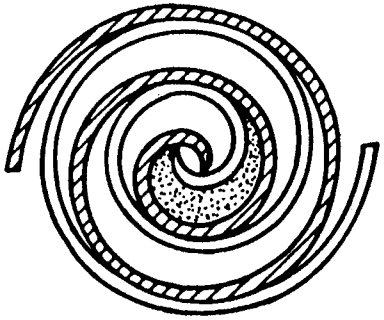

Suppose FIG. 2 represents a given moment during compression, then FIGS. 3, 4 and 5 represent, in sequence, the subsequential moments of the same compression cycle of FIG. 2. As a matter of fact, each of moments is when the orbiting scroll member orbits a quarter circle from a previous moment shown by the drawings. In other words, if a compression cycle begins at the phase of FIG. 2, FIG. 3 represents the phase at a quarter cycle from that shown in FIG. 2 and FIG. 4 is a further quarter cycle from FIG. 2 and FIG. 5 is an even further quarter cycle from FIG. 2 which, if viewed in another respect, is a quarter cycle leading FIG. 2. That means after FIG. 5, the orbiting scroll member 10 moves back to the location shown in FIG. 2. The compression cycle is then repeated.

Also disposed inside the housing 20, in a location opposite to the inter-engaged scroll members 10 and 30 with the frame 60, is a rotary motion driving means which in the embodiment shown in the drawings is an electrical motor 70 comprising a stator means 71 securely fixed on the housing 20, an armature 72 and a rotor means 73. As those skilled in the art know, by supplying an electrical power from a suitable source (not shown) to the electrical motor 70, the motor 70 will be actuated and the rotor means 73 rotated. A crankshaft 50 coaxially runs through the rotor means 73 and is secured thereon to be rotatable therewith.

The crankshaft 50 with an axis 53 extends in both ends thereof along the direction of the axis 53. The first end thereof extends into a lubricant reservoir 24 which forms in part the housing 20, preferably in a gravitational lowest location thereof, to receive therein a lubricant 25. The second end of the crankshaft 50 rotatably and axially movably runs through the frame to couple with and thus drive the orbiting scroll member 10.

The coupling between the crankshaft 50 and the orbiting scroll member 10 is done by a recess 14 formed on a side of the orbiting scroll member 10 opposite the orbiting scroll wrap plate 11 and an extension 54 formed on the second end of the crankshaft 50 to be coaxially received by the recess 14. The extension 54 has an axis 52 eccentric with respect to the axis 53 of the crankshaft 50 so that when the crankshaft 50 is rotated by the driving means 70, the axis 52 of the extension portion 54 and thus the recess 14 and the orbiting scroll member 10 orbits around the axis 53 of the crankshaft 50.

Bearing means may be disposed in any suitable location to reduce mechanical wear between the moving parts and fixed parts. For example, a bushing 62 may be interposed between the frame 60 and the crankshaft 50 to provide a smooth relative rotation therebetween. Due to the restriction from the Oldham-coupling ring 61, the orbiting scroll member 10 may also rotate with respect to the extension 54 of the crankshaft 50, a bushing 15 may be required between the recess 14 o the orbiting scroll member 10 and the extension portion 54 of the crankshaft 50. A lubricant channel 51 is formed in the crankshaft 50 to conduct the lubricant 25 stored in the reservoir 24 to at least these bushings for lubrication.

The end plates 12 and 31 and the wrap plates 11 and 32 of the scroll members 10 and 30 define at least a sealed chamber (the hatched area of FIGS. 2 to ) therebetween which is movable and size-changeable with the movement of the orbiting scroll member 10. A suction port which is preferably in the form of a tube 41 extending from outside the housing 20 to an inlet (not explicitly shown in the drawings) formed in the stationary scroll member 30 in the proximity to a low pressure region in the scrolls to allow the fluid to be compressed to flow into the sealed compression chamber 90 is installed to conduct the fluid to be compressed into the sealed compression chamber 90 when the sealed compression chamber 90 is in the low pressure region.

A discharge port 33 is formed on the end plate 31 of the stationary scroll member 30 in such a location to conduct the most compressed fluid, i.e. the fluid with the highest pressure in the scrolls, out of the sealed compression chamber 90 into a reserving container 22 which is formed by a surface of the stationary scroll member 30 opposite the stationary wrap plate 32 and a cover member 21 hermetically secured on the housing 20.

A passage 26 is formed from the reserving container 22 to the opposite side of the frame 60 to conduct the high pressure fluid stored in the reserving container 22, along the direction indicated by arrows A, to cool the electrical motor 70 and also to transfer its pressure to the lubricant 25 inside the lubricant reservoir 24. The high pressure fluid is then flow out of the housing 20 through a distribution port 23, along the direction indicated by arrows B, to supply to any appropriate post-treating device.

A space 63 is defined between the surface of the orbiting scroll member 10 opposite the orbiting scroll wrap 11 and the frame 50 to serve as a back pressure chamber. The back pressure chamber 63 is in fluid connection with the recess 14, for example, through a passage 65 formed on the extension 54 of the crankshaft 50, and the recess 14 is in turn in fluid connection with the lubricant reservoir 24 through the lubricant channel 51 so that the lubricant 25 which is pressurized by the high pressure compressed fluid flowing out of the sealed compression chamber 90 through the discharge port 33 and the passage 26 is conducted to the recess 14 and the back pressure chamber 63 and thus substantially filling the recess 14 and the back pressure chamber 63. The resultant force that acts upon the orbiting scroll member 10 by the pressurized lubricant biases the orbiting scroll member 10 toward the stationary scroll member 30 to reduce the axial gap formed between the free edge of the scroll wrap, such as that designated by the reference numeral 13 of FIG. 1, and the end plate opposing the free edge against the pressure of the fluid compressed inside the sealed compression chamber 90.

Figure 7:
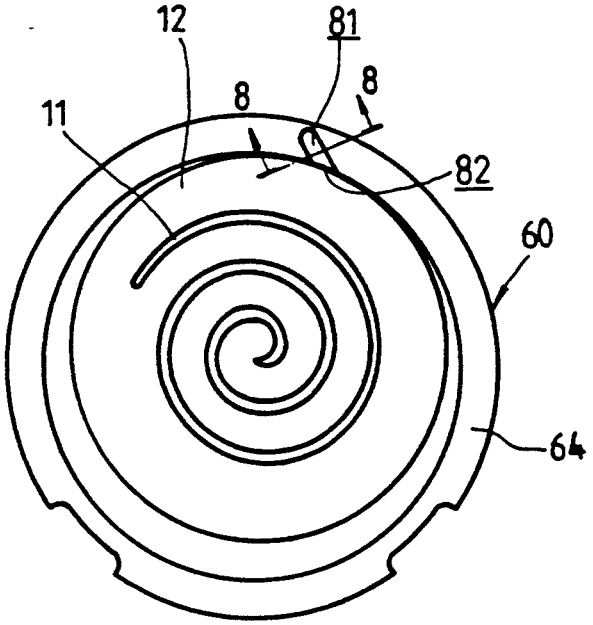
FIG. 7 is a top view showing the closing of the dynamic fluid resistance slot constructed in accordance with the present invention, the housing and the stationary scroll member being removed for a clear illustration.
Figure 8:
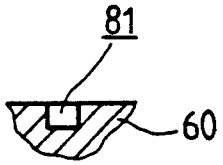
FIG. 8 is a cross-sectional view taken along line 8—8 of FIG. 7 to show the construction of the slot in accordance with the present invention.

Also referring to FIGS. 7 and 8, at least a slot 81 is formed on a flange shoulder 64 of the frame 60. The slot 81 extend laterally into the back pressure chamber 63 with a lateral opening 82 in such a manner that when the orbiting scroll member 10 orbits around the center of the stationary wrap plate 32 and passes the lateral opening 82, the lateral opening 8 will be blocked by the lateral edge of the end plate 12 of the orbiting scroll member 10 and then re-opened. Thus, when the orbiting scroll member 10 orbits around the center of the stationary wrap plate 32, the lateral opening 82 is cyclically closed and re-opened.

A capillary-like passage 80 of which the cross-sectional dimension is much less than the slot 81 is formed on the stationary scroll member 30 to connect the slot 81 to the suction tube 41. Since the suction tube 41 is in general at a low pressure and the lubricant 25 is at a pressure level close to that of the high pressure compressed fluid from the sealed compression chamber 90, the slot 81 and the capillary-like passage 80 serve to establish a connection between the back pressure chamber 63, which is at a mediate pressure level higher than the suction tube 41 but lower than the compressed fluid, and the low pressure suction tube 41 so that when the lateral opening 82 of the slot 80 is open, the pressure level of the back pressure chamber 63 will be lowered. The frequently repeated opening and closing of the slot 81 provides a dynamic fluid resistance to the fluid connection between the back pressure chamber 63 and the suction tube 41. Further, the capillary-like passage 80, due to its small cross-sectional dimension, provides a static fluid resistance to the fluid connection between the back pressure chamber 63 and the suction tube 41. With the combination of the dynamic fluid resistance of the slot 81 and the static fluid resistance of the capillary-like passage 80, the pressure drop in the back pressure chamber 63 resulted the connection with the low pressure suction tube 41 can be controlled and thus the back pressure will not drop to the same level as the suction tube pressure.

With an appropriate selection of the sizes and numbers of the slot 81 and the capillary-like passage 80, an approximately constant back pressure within a given range will be maintained in the back pressure chamber 63. Such a constant back pressure will result in a constant resultant force acting upon the orbiting scroll member 10 to maintain the gaps between the free edges of the wrap plates and the end plates in an acceptable value which is large enough to allow no frictional contacts between the scroll members while small enough to substantially seal the fluid to be compressed therebetween.

Experiments show that the diameter (for a circular cross section) and number of the capillary-like passage dominate the pressure drop of the back pressure The back pressure measured under the situation of only one capillary-like passage with a diameter of 4 mm is approximately 9.5 $Kgf/cm^2$ while that measured under the situation of two 2 mm diameter passages is approximately 11.5 $Kgf/cm^2$. The later value is quite close to the theoretical back pressure value and that of a commercial scroll compressor.

Since the capillary-like passage 80 and the slot 81 connect the back pressure chamber 63 to the suction tube 41, a small amount of lubricant 25 will flow into the suction tube 41 and then into the space between the scroll members with the fluid to be compressed. This small amount of lubricant 25 will fill into the gaps between the wrap plates and the end plates to provide a lubrication therebetween and also forming a lubricant film therebetween to further seal the gaps and thus further preventing the fluid to be compressed from leaking therethrough.

It is apparent that although the invention has been described in connection with a preferred embodiment, those skilled in the art may make changes to certain features of the preferred embodiment without departing from the spirit and scope of the invention as defined in the appended claims.

What is claimed is:

1. A scroll type compressor comprising a housing inside which a frame and a stationary scroll member, which includes an end plate with a wrap plate perpendicular mounted thereon, are securely fixed with the wrap plate of said stationary scroll member facing said frame to define therebetween a space for receiving therein an orbiting scroll member, which includes an end plate with a wrap plate of the same pitch with the wrap plate of the stationary scroll member extending therefrom into an inter-engagement with the wrap plate of said stationary scroll member so as to form at least a sealed compression chamber therebetween which is movable and size-changeable, said orbiting member being driven by a driving means to orbit around a center of the wrap plate of said stationary scroll member, a rotation preventive means being interposed between said orbiting scroll member and said frame to guide the orbiting motion of said orbiting scroll member, a suction port being provided to conduct a first fluid to be compressed, which is in a low pressure, into said compression chamber, which moves with the orbiting motion of said orbiting scroll member from a low pressure region to a high pressure region, to be moved therewith to the high pressure region and thus compressed to be a high pressure, a discharge port being provided on said stationary scroll member to conduct the first fluid compressed in said compression chamber out thereof, wherein:

a back pressure chamber is formed between said orbiting scroll member and said frame to receive therein a high pressure second fluid from a second fluid source, at least a slot is formed on said frame with an opening in communication with said back pressure chamber in such a manner that when said orbiting scroll member is driven by said driving means to orbit around the center of said stationary wrap plate and reaches said opening, said opening is closed and when said orbiting scroll member leaves, said opening is re-opened to be in communication with said back pressure chamber again, at least a capillary-like passage with a cross-sectional dimension smaller than said slot is formed on said stationary scroll member to connect said slot to said low pressure suction port, said capillary-like passage having such a small cross-sectional dimension so that when the opening is open to establish a fluid connection between said low pressure suction port and said back pressure chamber, a static fluid resistance is developed inside said capillary-like passage, which in combination with a dynamic fluid resistance established by the closing and re-opening of said opening serves to maintain said back pressure in an approximately constant pressure level.

2. A scroll type compressor as claimed in claim 1 wherein said driving means is an electrical motor comprising a stator securely fixed on said housing and a rotor with a crankshaft co-axially secured thereon to be actuated by an electrical power source, said crankshaft having a first end and a second end opposite to each other, an extension formed on said second end extending into a recess formed on a surface of said orbiting scroll member opposite to the orbiting wrap plate to form an orbiting motion transfer coupling, said extension having an axis eccentric with respect to an axis of said crankshaft so that when said crankshaft is driven and rotated by said electrical motor, said extension axis orbits around said crankshaft axis to have said orbiting scroll member orbit around the center of said stationary wrap plate.

3. A scroll type compressor as claimed in claim 1 wherein said second fluid is a lubricant stored in a lubricant reservoir, which constitutes said second fluid source, for lubricating said scroll type compressor, said high pressure compressed first fluid discharged from said discharge port formed on said stationary scroll member being conducted through a passage to said lubricant reservoir to pressurize said lubricant and thus forwarding said lubricant into said back pressure chamber through a lubricant channel.

4. A scroll type compressor as claimed in claim 3 wherein said slot and said capillary-like passage constitute a passageway for conducting a small amount of the lubricant into gaps between the wrap plates and the end plates of said scroll members to form a fluid film therein for lubrication and reduction of friction between the scroll members.

5. A scroll type compressor as claimed in claim 1 wherein said driving means is an electrical motor comprising a stator securely fixed on said housing and a rotor with a crankshaft co-axially secured thereon to be actuated by an electrical power source, said crankshaft having a first end and a second end opposite to each other, an extension formed on said second end extending into a recess formed on a surface of said orbiting scroll member opposite to the orbiting wrap plate to form an orbiting motion transfer coupling, said extension having an axis eccentric with respect to an axis of said crankshaft so that when said crankshaft is driven and rotated by said electrical motor, said extension axis orbits around said crankshaft axis to have said orbiting scroll member orbit around the center of said stationary wrap plate, and wherein said second fluid is a lubricant stored in a lubricant reservoir, which constitutes said second fluid source and into which said first end of said crankshaft extending, for lubricating said scroll type compressor, said high pressure compressed first fluid discharged from said discharge port formed on said stationary scroll member being conducted through a passage to said lubricant reservoir to pressurize said lubricant and thus forwarding said lubricant into said back pressure chamber through a lubricant channel formed in said crankshaft and in communication with said lubricant reservoir.

6. A scroll type compressor as claimed in claim 1 wherein said rotation preventive means is an Oldham-coupling ring.

7. A scroll type compressor as claimed in claim 1 wherein only a capillary-like passage of 4 mm diameter is formed on said frame.

* * * * *